US007581909B2

(12) United States Patent
Szoke

(10) Patent No.: US 7,581,909 B2
(45) Date of Patent: Sep. 1, 2009

(54) FASTENER

(76) Inventor: Stefan Joseph Szoke, 30 Blackbutt Circle, Mt. Riverview, NSW 2774 (AU)

( * ) Notice: Subject to any disclaimer, the term of this patent is extended or adjusted under 35 U.S.C. 154(b) by 212 days.

(21) Appl. No.: 10/587,056

(22) PCT Filed: Feb. 8, 2005

(86) PCT No.: PCT/AU2005/000148

§ 371 (c)(1),
(2), (4) Date: Jul. 21, 2006

(87) PCT Pub. No.: WO2005/083296

PCT Pub. Date: Sep. 9, 2005

(65) Prior Publication Data

US 2007/0155234 A1 Jul. 5, 2007

(30) Foreign Application Priority Data

Feb. 26, 2004 (AU) ..... 2004900980

(51) Int. Cl.
*F16B 23/00* (2006.01)

(52) U.S. Cl. ..... 411/401; 411/396

(58) Field of Classification Search ..... 411/389, 411/396, 400, 401
See application file for complete search history.

(56) References Cited

U.S. PATENT DOCUMENTS

| | | | | |
|---|---|---|---|---|
| 2,812,971 | A * | 11/1957 | Teutsch | 294/82.1 |
| 2,851,294 | A | 9/1958 | Mount | |
| 4,306,696 | A * | 12/1981 | Pondman | 248/59 |
| 4,662,807 | A * | 5/1987 | Lien et al. | 411/368 |
| 5,054,982 | A * | 10/1991 | Freeman | 411/400 |
| 5,518,351 | A * | 5/1996 | Peil | 411/383 |
| 6,270,304 | B1 * | 8/2001 | Freedland | 411/392 |
| 6,443,680 | B1 * | 9/2002 | Bodin | 411/396 |
| 6,679,480 | B1 | 1/2004 | Hara et al. | |
| 6,848,346 | B1 * | 2/2005 | Panasik | 81/438 |

FOREIGN PATENT DOCUMENTS

| | | |
|---|---|---|
| JP | 11-344081 | 12/1999 |
| JP | 11-344081 A | 12/1999 |
| WO | 98/08003 A | 2/1998 |

OTHER PUBLICATIONS

Patent Abstract of Japan 11-344081 Published Dec. 14, 1999.

* cited by examiner

*Primary Examiner*—Flemming Saether
(74) *Attorney, Agent, or Firm*—Ladas & Parry LLP

(57) ABSTRACT

A coupling (10) to attach a stainless steel cable (11) to a post (12). Typically the post (12) would be formed of timber. The coupling (10) includes a threaded member (14) that is inserted in the post (12), the member (14) having a head (15). Rotatably engaged by the head (15) is a sleeve (20) that is internally threaded and threadably receives a shaft (23). The shaft (23) has fixed to it the cable (11).

8 Claims, 1 Drawing Sheet

FASTENER

TECHNICAL FIELD

The present invention relates to fasteners and more particularly but not exclusively to attach and tension cable to timber structures.

BACKGROUND OF THE INVENTION

Rails including balustrades often employ tensioned stainless steel cable. The cable is attached to posts with turnbuckles then rotated to tension the cable. The abovementioned means of attaching and tensioning stainless steel cable is time consuming and therefore expensive to install.

OBJECT OF THE INVENTION

It is the object of the present invention to overcome or substantially ameliorate the above disadvantage.

SUMMARY OF THE INVENTION

There is disclosed herein a coupling having a longitudinal axis and adapted to attach a threaded shaft to a structure, said coupling including:

a threaded rod extending along said axis and to engage the structure so as to be fixed thereto, the rod terminating at an end with a head having a tool engaging portion; and a turn member also extending along said axis and including a hollow base within which said head is located, and a sleeve extending from the head, the sleeve including a threaded passage to threadably engage said shaft so that upon said rod being engaged with said structure and said sleeve rotated about said axis relative to said shaft, said shaft is moved longitudinally of said passage.

Preferably, said head includes a tool engaging portion, said tool engaging portion being exposed to said passage to provide for a tool passing through said passage to engage said portion to enable a user to rotate said rod.

Preferably, said rod is adapted to penetrate timber.

Preferably, said sleeve includes surfaces to be engaged by a tool to aid in rotating said sleeve about said axis.

There is further disclosed herein in combination, the above described coupling and said shaft, with a cable attached to said shaft.

BRIEF DESCRIPTION OF THE DRAWINGS

A preferred form of the present invention will now be described by way of example with reference to the accompanying drawings where.

DETAILED DESCRIPTION OF THE PREFERRED EMBODIMENT

Figure 1:
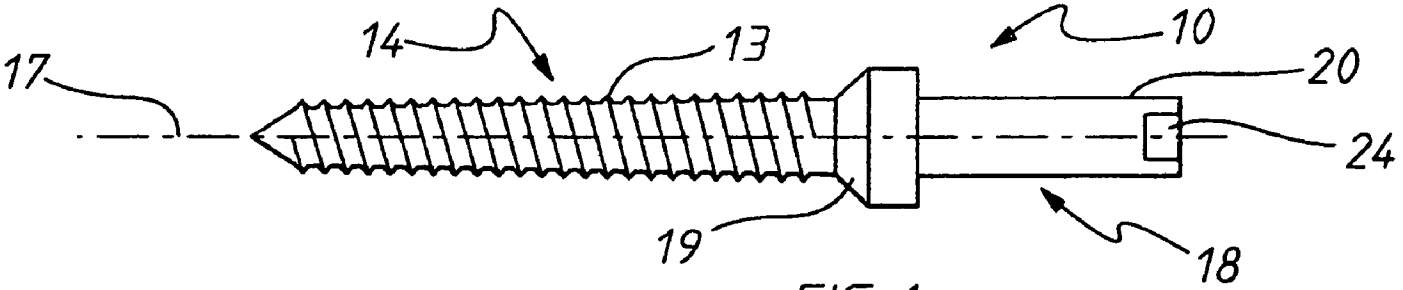
FIG. 1 is a schematic side elevation of a coupling to attach a cable to a post.
Figure 2:
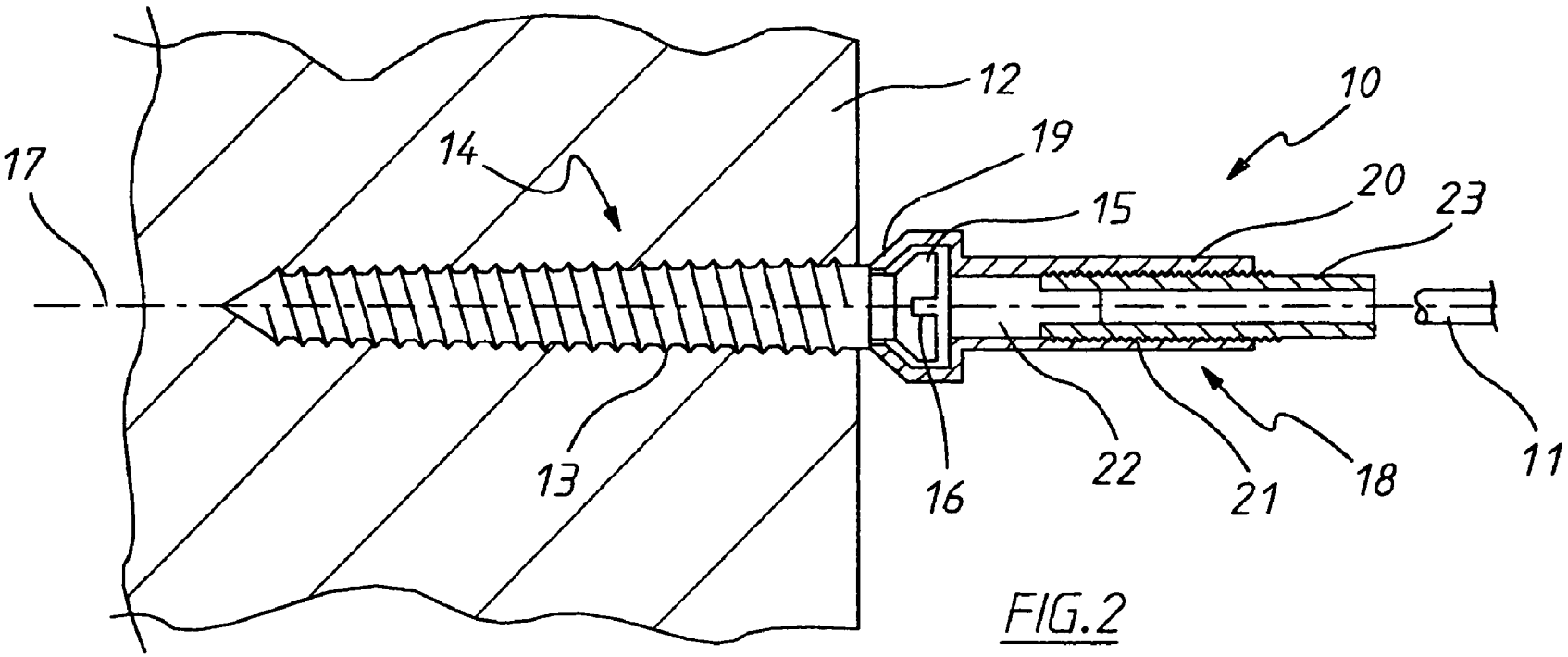
FIG. 2 is a schematic sectioned side elevation of the coupling of FIG. 1.

In the accompanying drawings there is schematically depicted a coupling 10 to attach a stainless steel cable 11 to a post 12. Typically the post 12 will be formed of timber.

The coupling 10 includes a threaded member 14 having a threaded length 13 embedded in the post 12. The member 14 terminates at one end with a head 15 having a tool engaging portion 16 in the form of a slot so that a screw driver may be engaged therein to cause rotation of the threaded member 14 about the longitudinal axis 17 to insert the length 13 in the post 12.

Operatively associated with the member 14 is a turn member 18 having a hollow base 19 within which the head 15 is located. Extending from the base 19 away from the head 15 is a sleeve 20. The sleeve 20 has as its longitudinal axis, the axis 17.

The sleeve 20 is internally threaded so as to have a threaded length 21. The sleeve 21 has a longitudinal internal passage 22 via which a user is able to insert a tool to engage the slot 16 to rotate the member 14 about the axis 17 to insert the length 13 in the post 12.

Once the length 13 is fully inserted a threaded shaft 23 is threadably engaged with the sleeve 20, with the sleeve 20 rotated about the longitudinal axis 17 so that the shaft 23 moves into the passage 22. Attached to the shaft 23 is the cable 11. More particularly the sleeve 20 has "flat" portions 24 so that it may be gripped by an appropriate tool to be rotated about the axis 17. Rotation of the sleeve 20 would also tension the cable 11 as well as attach the cable 11 to the sleeve 20.

The base 19 encompasses the head 15 so that the sleeve 20 can rotate about the axis 17 relative to the member 14. It should also be appreciated that the head 15 is captively located within the base 19 so that when the cable 11 is tensioned the base 19 still remains attached to the head 15.

The invention claimed is:

1. A coupling, having a longitudinal axis for attaching a threaded shaft to a structure, said coupling including:

a threaded rod extending along said axis and to threadably engage the structure, the rod terminating at an end with a head having a tool engaging portion; and a turn member also extending along said axis and including a hollow base having a cavity within which said head is captively located, and a sleeve attached to the base and extending from the head and said rod along said axis, the sleeve including a treaded passage to threadably engage a shaft, the threaded passage of the sleeve having an end that opens into the cavity in the hollow base and has a transverse width that is less than the transverse width of the end of the rod with the head whereby the head is prevented from entering the passage and is thereby captively retained in said captivity, the threaded rod being rotatable about the longitudinal axis relative to said turn member with the head captively disposed in the cavity at the end of the threaded passage, wherein said tool engaging portion is disposed at the end of the threaded passage and is exposed to said passage and configured to provide for a tool to pass along said passage to engage said portion to enable a user to rotate said rod about said axis relative to said member with said head disposed in said cavity, wherein the cavity has an axial dimension that is of about the same size as an axial dimension of the head.

2. The coupling of claim 1, wherein said rod is adapted to penetrate timber.

3. The coupling of claim 1, wherein said sleeve includes surfaces to be engaged by a tool to aid in rotating said sleeve about said axis.

4. A combination comprising the coupling of claim 1, a shaft threadably engaged in the threaded passage of the coupling and a cable attached to said shaft.

5. The coupling of claim 2, wherein said sleeve includes surfaces to be engaged by a tool to aid in rotating said sleeve about said axis.

6. A combination comprising the coupling of claim 2, a shaft threadably engaged in the threaded passage of the coupling and a cable attached to said shaft.

7. A combination comprising the coupling of claim 3, a shaft threadably engaged in the threaded passage of the coupling and a cable attached to said shaft.

8. The coupling of claim 1, wherein the passage has a uniform diameter.

* * * * *